US007849777B1

(12) United States Patent
Zedrosser

(10) Patent No.: US 7,849,777 B1
(45) Date of Patent: Dec. 14, 2010

(54) FIREARM WITH AN IMPROVED BREECH BOLT ASSEMBLY

(75) Inventor: Ulrich Zedrosser, Steyr (AT)

(73) Assignee: Fabbrica D'Armi Pietro Beretta S.p.A., Gardone Val Trompia (IT)

( * ) Notice: Subject to any disclaimer, the term of this patent is extended or adjusted under 35 U.S.C. 154(b) by 263 days.

(21) Appl. No.: 12/245,170

(22) Filed: Oct. 3, 2008

(30) Foreign Application Priority Data

Oct. 4, 2007 (IT) ..... MI2007A1909

(51) Int. Cl.
*B64D 1/04* (2006.01)

(52) U.S. Cl. ..... 89/1.4; 89/164; 89/169; 89/181; 89/22; 89/23; 89/24; 42/16

(58) Field of Classification Search ..... 89/1.4, 89/164, 169, 181, 22, 23, 24; 42/16
See application file for complete search history.

(56) References Cited

U.S. PATENT DOCUMENTS 3,225,653 A * 12/1965 Packard ..... 89/1.4
3,969,983 A * 7/1976 Zellweger et al. ..... 89/185
4,052,926 A * 10/1977 Tollinger ..... 89/1.4
4,191,089 A * 3/1980 Zedrosser ..... 89/181
4,655,118 A * 4/1987 Bruderer et al. ..... 89/185
5,920,028 A * 7/1999 Guhring et al. ..... 89/188
7,444,775 B1 * 11/2008 Schuetz ..... 42/76.01
7,707,921 B1 * 5/2010 Hoel ..... 89/1.4
7,721,639 B2 * 5/2010 Wossner ..... 89/181
2005/0223613 A1 * 10/2005 Bender ..... 42/16
2007/0006720 A1 * 1/2007 Liao ..... 89/1.4

* cited by examiner

*Primary Examiner*—Troy Chambers
*Assistant Examiner*—Samir Abdosh
(74) *Attorney, Agent, or Firm*—Oblon, Spivak, McClelland, Maier & Neustadt, L.L.P.

(57) ABSTRACT

A firearm with an improved breech bolt assembly comprises a barrel (12), a breech bolt assembly (18, 21), a body (14) equipped on opposite sides with ports (15) for the ejection of a cartridge case, in addition to a magazine (17), wherein the breech bolt assembly, which is moveable with respect to the body (14) comprises a breech bolt-holder slide (21), a breech bolt (18) equipped with a rotating locking head (25), cam guide rails (26, 27) of the relative movement between the breech bolt (18) and slide (21), and also stopping means (28, 29) of the relative movement comprising a control pin (28) which can be moved vertically with respect to a first control seat (29), charged by a recoil spring (30) applied between the slide (21) and the pin (28), said pin (28) having a cocking handle (23), or reloading lever, rotatingly applied thereto, for the manual moving of the breech bolt assembly (10).

13 Claims, 12 Drawing Sheets

FIREARM WITH AN IMPROVED BREECH BOLT ASSEMBLY

The present invention relates to a firearm with an improved breech bolt assembly.

A breech bolt assembly, comprising a breech bolt-slide and a breech bolt equipped with a locking head, is contained inside a body of a firearm, such as a repeat gun, and can be moved axially with respect to this.

The breech bolt, in particular, is housed in the slide so as to have a limited rotating and axial translatory movement for the opening of the firing chamber and its closing at the moment of firing.

To enable the breech bolt to close the firing chamber, it must be equipped with closing guide rails activated by the relative movement between the slide and breech bolt, which takes place at the end of the advance movement of the breech bolt. In particular, during the advance and withdrawal of the breech bolt assembly the relative movement between the breech bolt and slide is prevented, except at the moment of closing and opening, when the breech bolt must also rotate with respect to the slide. This rotation is achieved by means of a cam of the slide engaged with a corresponding cursor of the breech bolt.

The movement of the breech bolt also has the functions of housing a cartridge in the firing chamber from the magazine and ejecting a cartridge or cartridge case from the firing chamber.

The loading or reloading procedure of the arm, which is effected by moving the breech bolt along the direction of the barrel, is equally applied in the case of manual, semi-automatic or automatic functioning. In any case, for all the functioning modes mentioned, the loading procedure of the first cartridge must be effected manually. For this reason all firearms with a magazine are equipped with a cocking handle, or reloading lever, produced in different ways.

The cocking handle, which is connected to the breech bolt and protrudes from the body of the arm, allows the user to intervene manually on the breech bolt without being able to reach this with his hand.

According to what is known, the cocking handle is alternatively produced as part of the body, connected to the breech bolt by means of a joint, or it can be directly connected to the breech bolt itself, generally removably to allow the dismantling of the firearm.

A simple and effective solution of the second type described consists in a cocking handle rigidly connected to the breech bolt protruding outside the body by means of a suitable opening or port. In this case, the port must be sufficiently long, in an axial direction, to allow the necessary movement of the breech bolt for the loading or unloading procedure.

An objective of the present invention is to provide a firearm with an improved breech bolt assembly which guarantees a correct opening and closing synchronism of the firearm.

A further objective of the present invention is to produce a firearm with an improved breech bolt assembly which allows an ambidextrous use.

Another objective of the present invention is to provide a firearm with an improved breech bolt assembly which can be rapidly and simply disassembled without the help of specific tools and in which there are no small-sized loose components.

These objectives according to the present invention are achieved by producing a firearm with an improved breech bolt assembly as specified in claim 1.

Further characteristics are indicated in the dependent claims.

The characteristics and advantages of a firearm with an improved breech bolt assembly according to the present invention will appear more evident from the following illustrative and non-limiting description, referring to the enclosed schematic drawings, wherein:

FIGS. 11A-13A and 11B-13B show a sectional view of various rotation phases of the cocking handle in the firearm according to the invention.

With reference to the figures, these show a firearm with an improved breech bolt assembly indicated as a whole with 100.

Figure 1:
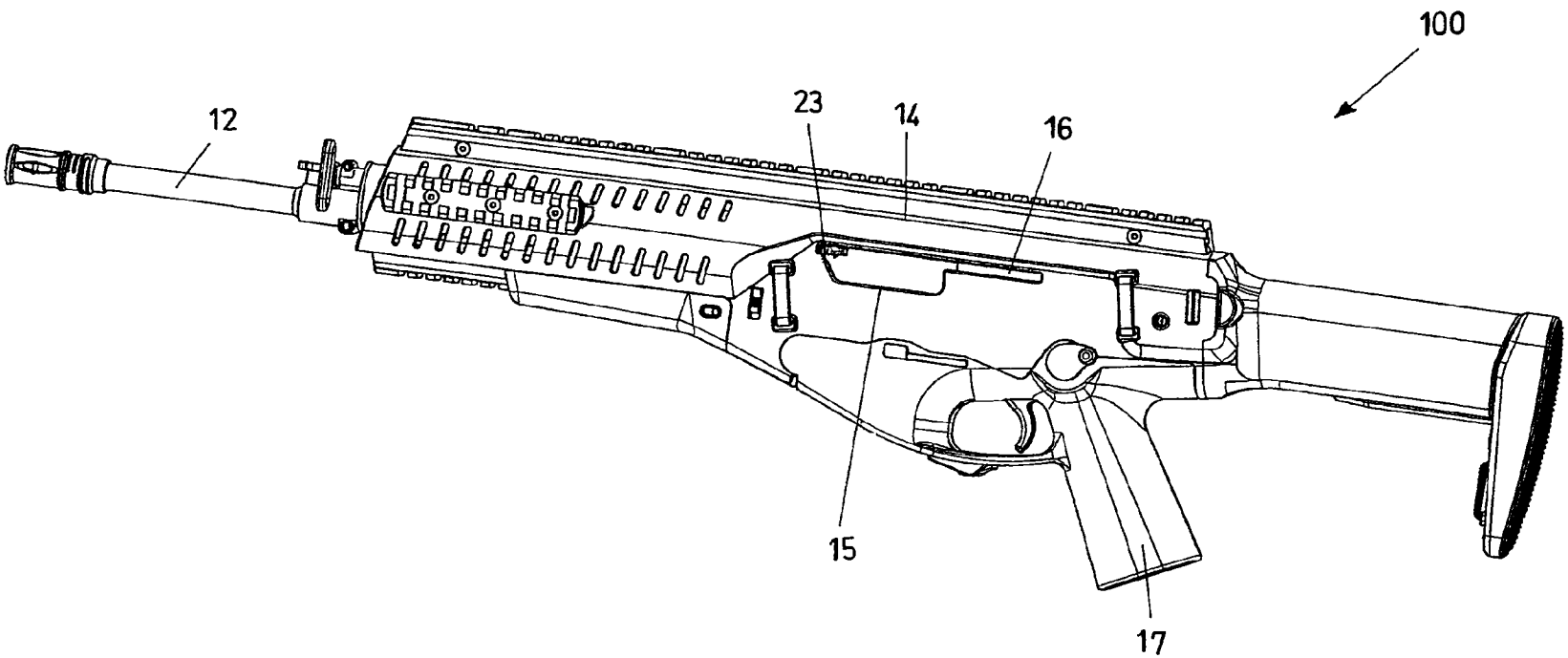
FIG. 1 is a perspective view of a firearm equipped with an improved breech bolt assembly according to the invention.

The firearm 100, shown for illustrative and non-limiting purposes in FIG. 1, comprises a breech bolt assembly 10, a barrel 12, a body 14, or outer shell, also equipped on opposite sides with symmetrical openings 15, or ports, for the right or left ejection of a cartridge case, in addition to a magazine 17.

Figure 3:
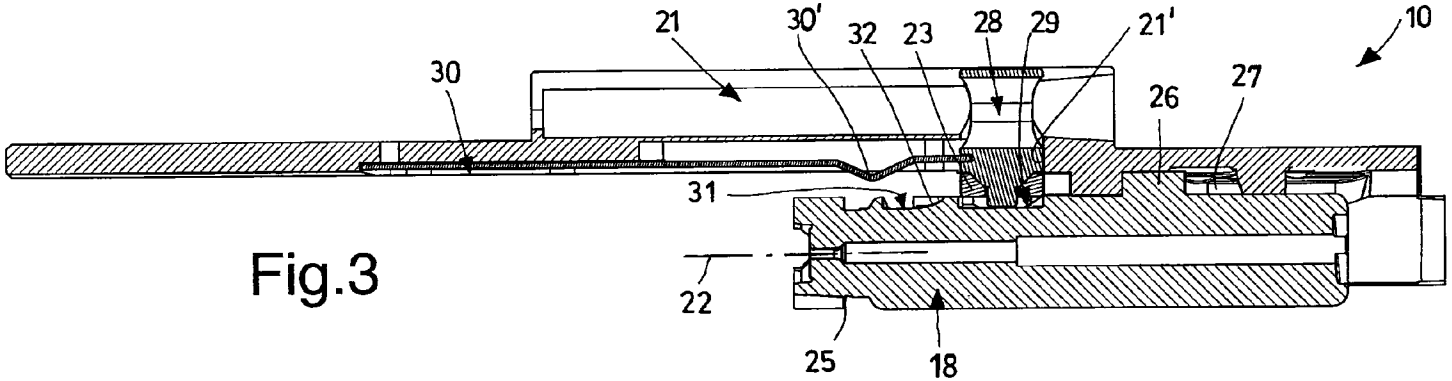
FIG. 3 shows a section according to the trace III-III of the breech bolt assembly of FIG. 2.
Figure 2:
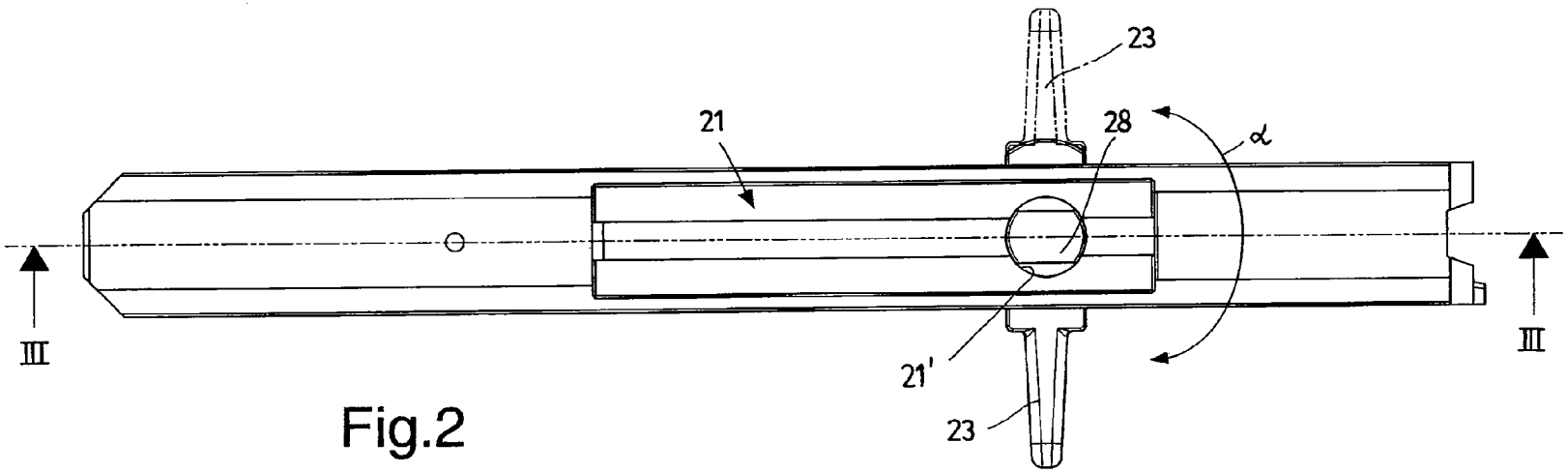
FIG. 2 is a plan view of the breech bolt assembly according to the invention.
Figure 4:
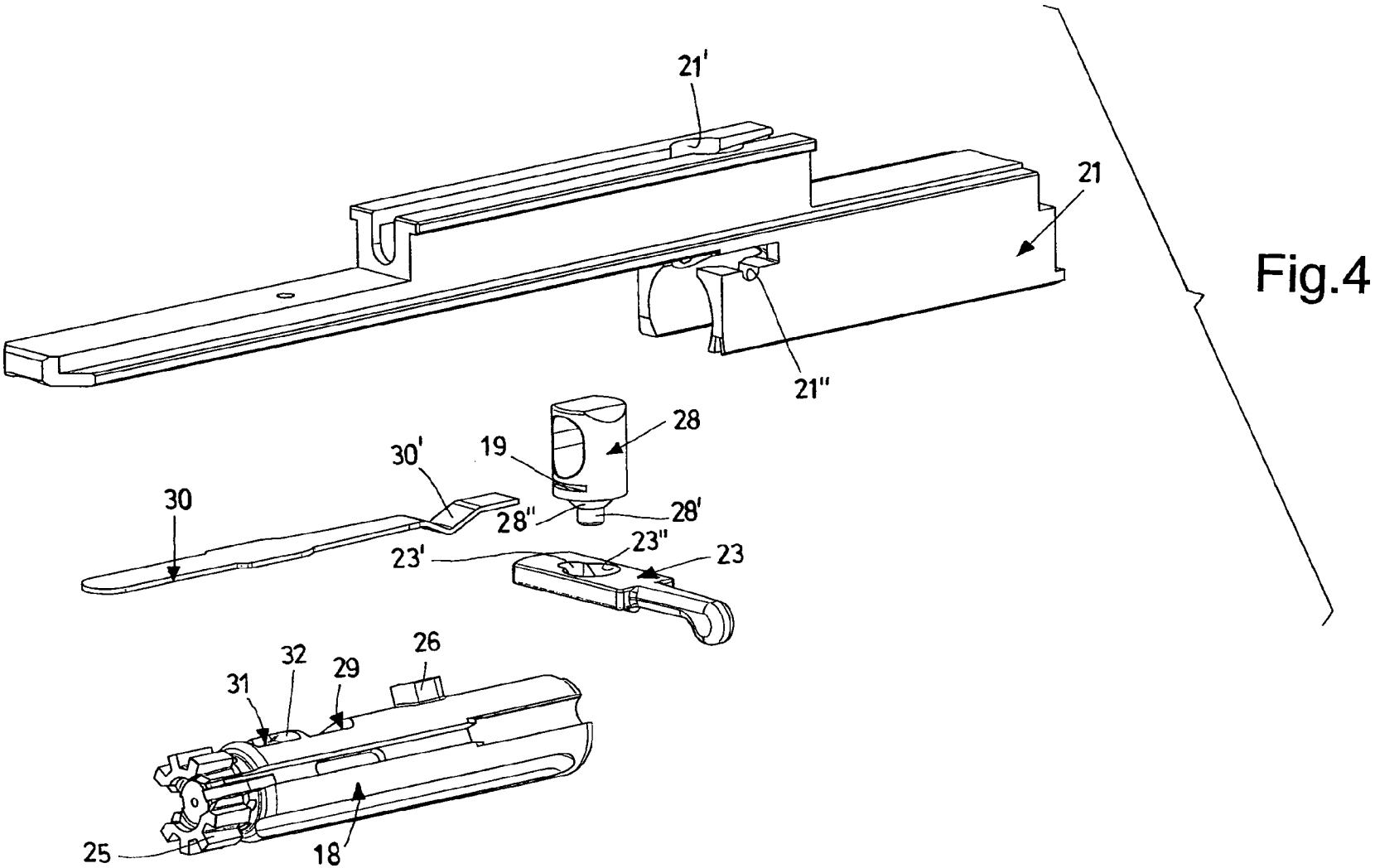
FIG. 4 is an exploded view of some details of the breech bolt assembly according to the invention.

The breech bolt assembly, shown in FIGS. 2-4, comprises a breech bolt 18 and a breech bolt-holder slide 21, which can be moved together and separately in a direction parallel to the axis 22 of the barrel 12, or axis of the firearm. The breech bolt 18 is equipped, at a front end, with a head 25 which is engaged in a barrel extension 24, indicated for example in FIG. 5, integral with the barrel 12 for the closing and opening of a firing chamber by rotation.

The ejection ports of the cartridge cases 15 comprise a slit extension 16 towards the rear end of the opening 15, having a lower height with respect to the port, to allow a cocking handle 23, or reloading lever, to effect its necessary run.

According to the invention, the cocking handle 23, which allows the user to intervene manually on the breech bolt assembly 10, according to what is shown in FIGS. 2 and 3, is assembled between the breech bolt 18 and the slide 21. In particular, according to the non-limiting example provided, the slide 21 is equipped on both sides close to the cocking handle 23 with seats 21" for coupling with complementary reliefs 123 of the cocking handle 23.

The cocking handle, when in use, is positioned orthogonally with respect to the axis of the barrel 22 protruding laterally from the body 14 of the firearm 100 through the ports 15 alternating on one side or on the other side, as described and illustrated hereunder.

During the withdrawal of the breech bolt assembly 10 after the opening phase of the head 25 by rotation and until the closing of the head 25 by rotation, stopping means prevent the relative movement between the breech bolt 18 and slide 21. The stopping means consist of a control pin 28, housed inside a seat 21' of the slide 21 and which can be moved vertically to respectively disengage itself from a control seat 29 in the breech bolt 18, overcoming the force of a specific recoil spring 30.

When the breech bolt 18 is closed, the control pin is housed in a second containment seat 31 in the breech bolt 18 in an advanced position with respect to the control seat 29.

Cam guide rails of the vertical lifting of the control pin 28 are also envisaged, comprising a ramp 32 situated at a rear end of the containment seat 31 and a tilted coupling surface 24' of the barrel extension 24.

The control pin 28 comprises a main cylindrical body coupled with the seat 21' of the slide and a feeler end 28', for example cylindrical with a smaller diameter, connected to the main body by conical surfaces 28" complementary to a conical hole 23" of the cocking handle 23.

By pulling the cocking handle transversally with respect to the axis 22, the control pin 28 is raised vertically due to the contact on the complementary conical surfaces. The passage of the cocking handle 23 in a transversal direction with respect to the axis 22 is enabled by the presence of a grooved seat 23' situated in the conical hole 23".

The recoil spring 30 is, for example, a lamina spring constrained at a first end to the breech bolt-slide 21 and at the opposite end coupled with a seat 19 on the control pin 28. The lamina spring comprises a "V"-folded portion 30' near the constraining end with the pin 28. The front branch of the folded portion 30' is engaged with the tilted surface 24', or cam, of the barrel extension 24 during the closing phases of the breech bolt.

The barrel extension 24 is also equipped with a seat 24" for containing the folded portion 30' of the spring 30 under closed breech bolt conditions.

Figure 5:
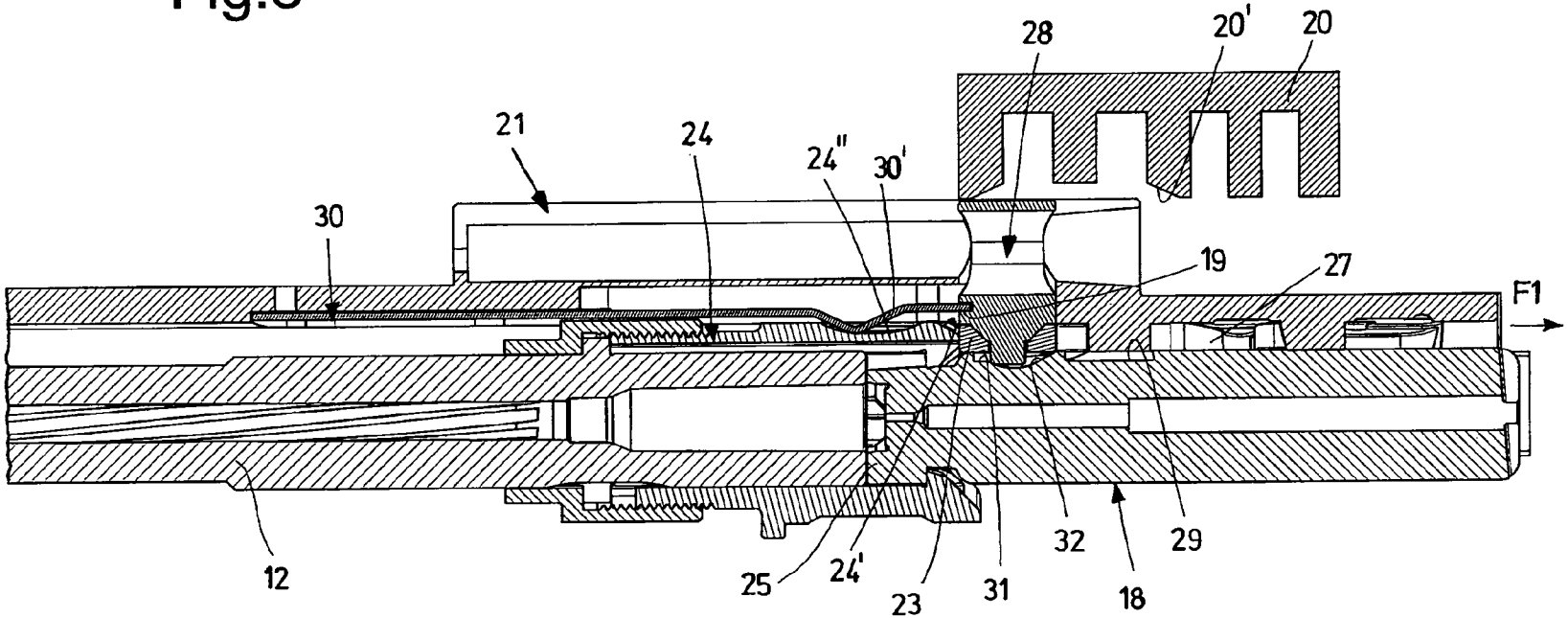
FIGS. 5-8 show a sectional view of some of the functioning opening phases of the improved breech bolt assembly according to the invention.

Further cam control means of the vertical lifting of the control pin 28, consist in a cam 20, shown for example in FIG. 5, integral with the body 14 in an upper facing position with respect to the control pin 28, which, in correspondence with a cavity 20', allows the vertical movement of the control pin 28 only within a pre-established range of the relative movement between the slide 21 and the body 14.

The breech bolt assembly 10, shown in FIG. 3 in section in an open breech bolt position, also has cam guiding means of the rotation for the closing or opening of the breech bolt which comprise a guiding cursor 26, situated in one piece on the breech bolt 18, which can be moved in engagement with a cam 27 of the slide 21.

The guiding means of the rotation of the breech bolt 10 are activated by the relative movement between the slide 21 and breech bolt 18.

The opening of the breech bolt assembly, described on the base of FIGS. 5 to 8, which schematically show the reciprocal movement of the components, begins with the relative withdrawal movement of the breech bolt 18 with respect to the slide 21 (schematized in FIG. 5 with the arrow F1).

Figure 6:
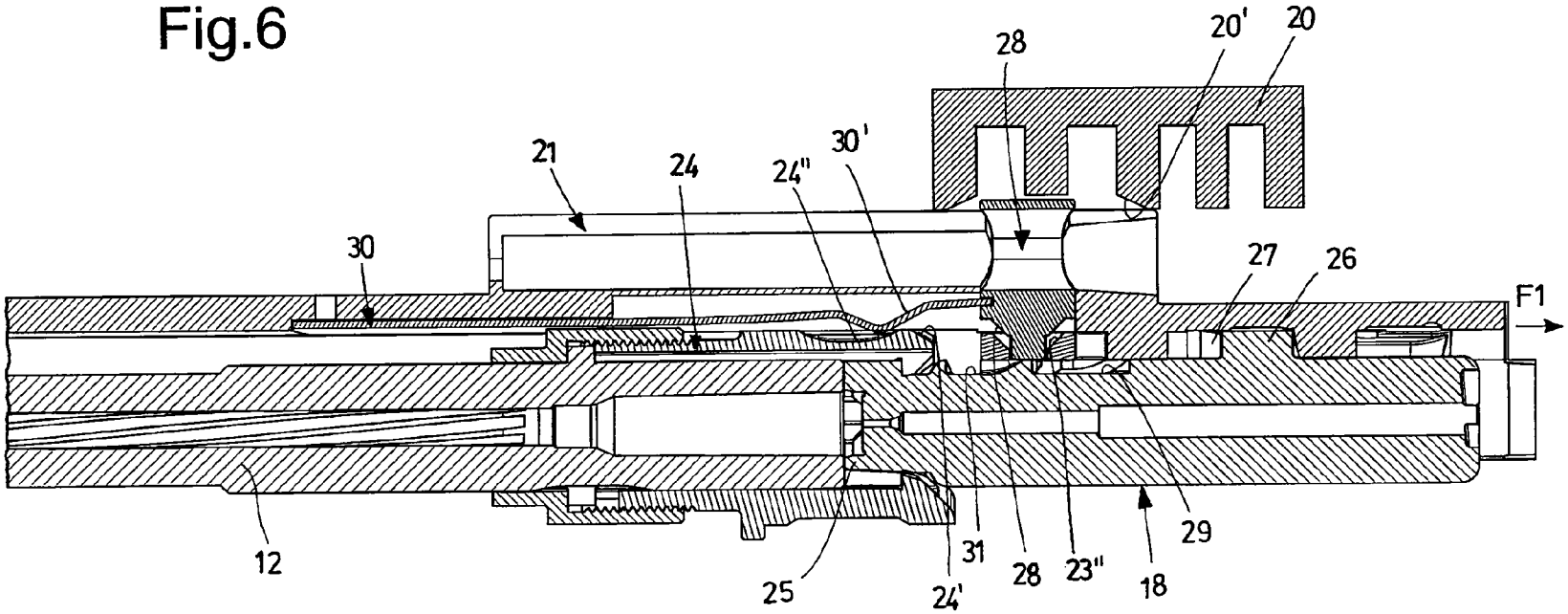
Figure 7:
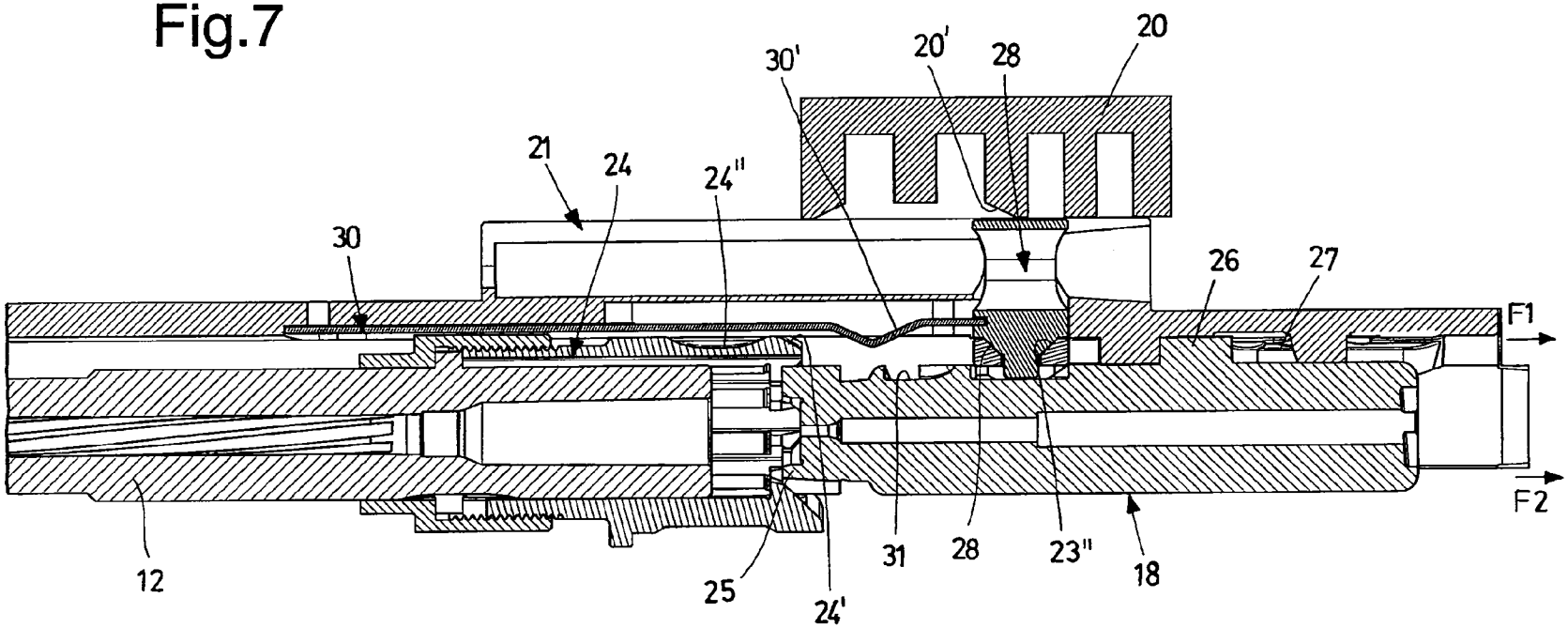

The control pin 28, which is initially housed in the containment seat 31, is lifted vertically, guided by the ramp 32, until it is disengaged from the breech bolt. The cavity 20' of the cam 20 in the body 14 allows the control pin 28 to have this extracted position. Furthermore, the withdrawal of the slide 21 with respect to the breech bolt 18, due to the cam 27, causes the rotation of the breech bolt 18 itself and therefore the opening (FIG. 6).

The further withdrawal of the slide 21 causes the upper end of the control pin 28 to interfere with the cam 20 of the body, which causes the vertical lowering of the pin 28 engaged with the control seat 29 of the breech bolt 18. The action of the recoil spring 30, loaded by the previous lifting of the pin, also contributes to engage the pin 28 in the control seat 29.

When the pin 28 is engaged in the control seat 29 (FIG. 7), the reciprocal movement between the slide 21 and breech bolt 18 is prevented, until the pin 28 is unblocked. In particular, the control seat 29 does not allow the rotation of the breech bolt 18. The withdrawal of the slide 21, according to the arrow F1, consequently also integrally entrains the breech bolt 18 according to the arrow F2.

Figure 8:
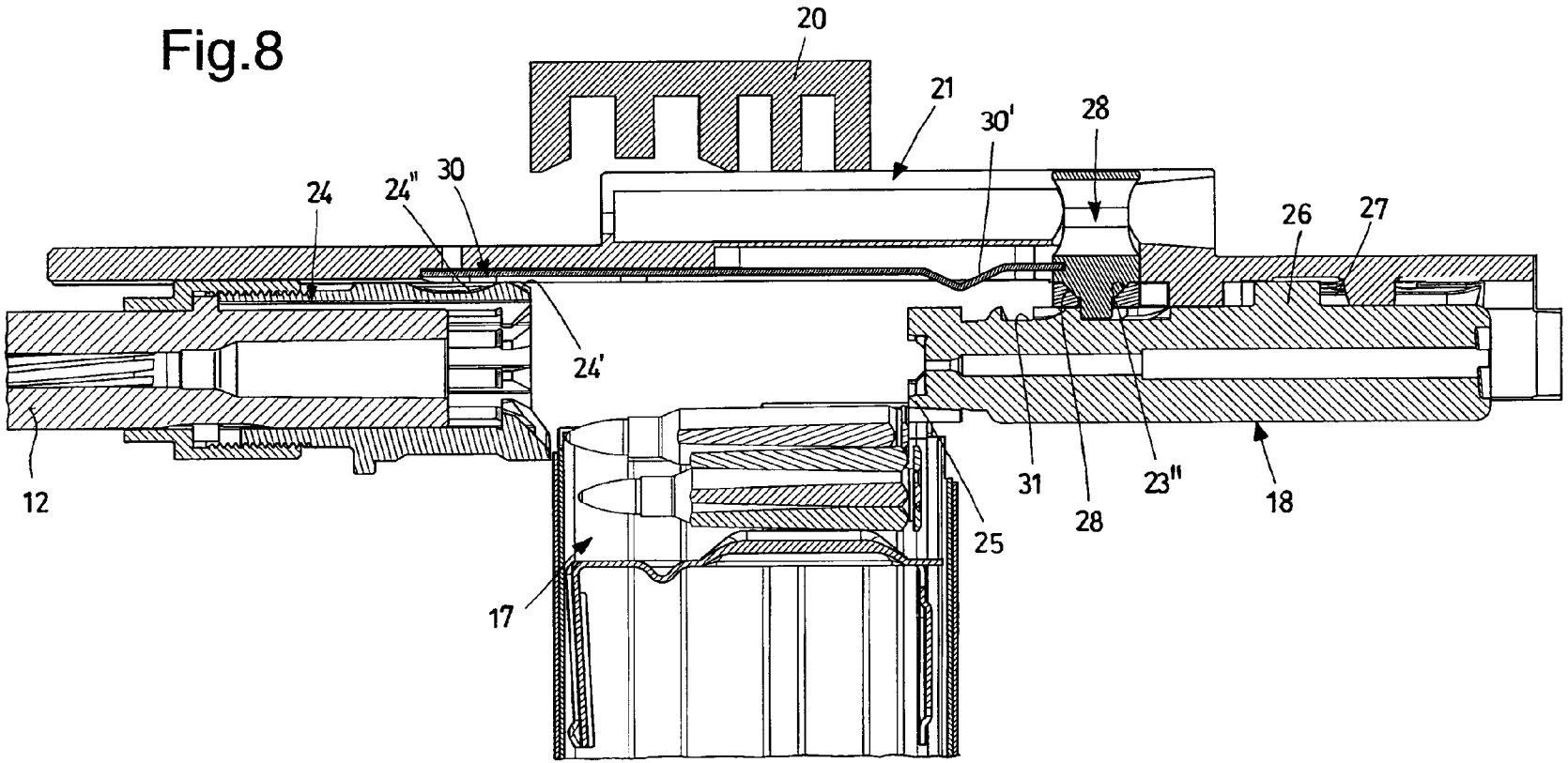

The withdrawal of the slide 21 and breech bolt 18 terminates with the possibility of housing a cartridge in the configuration of FIG. 8.

Figure 9:
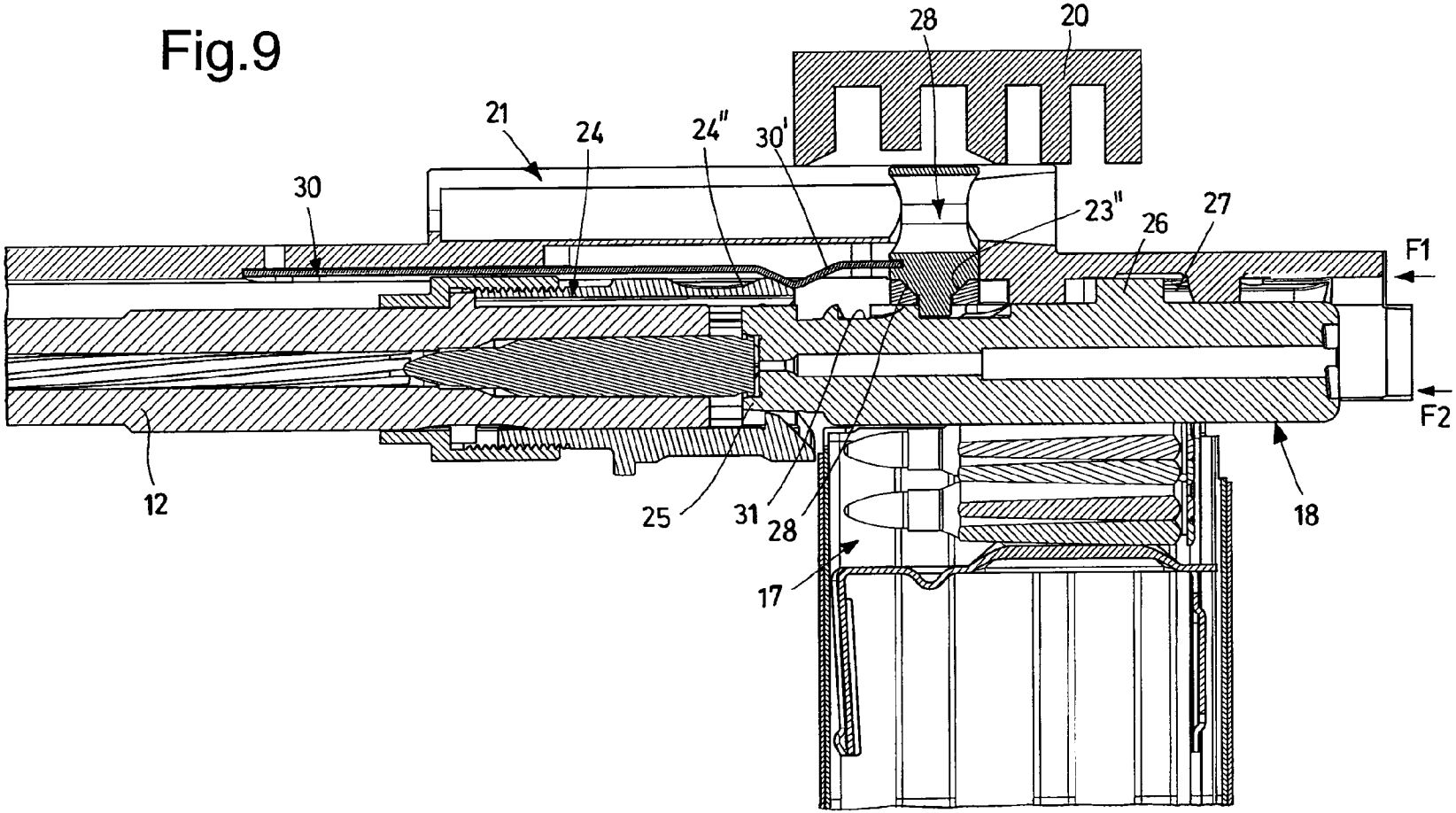
FIGS. 9 and 10 show a sectional view of some of the functional closing phases of the improved breech bolt assembly according to the invention.
Figure 10:
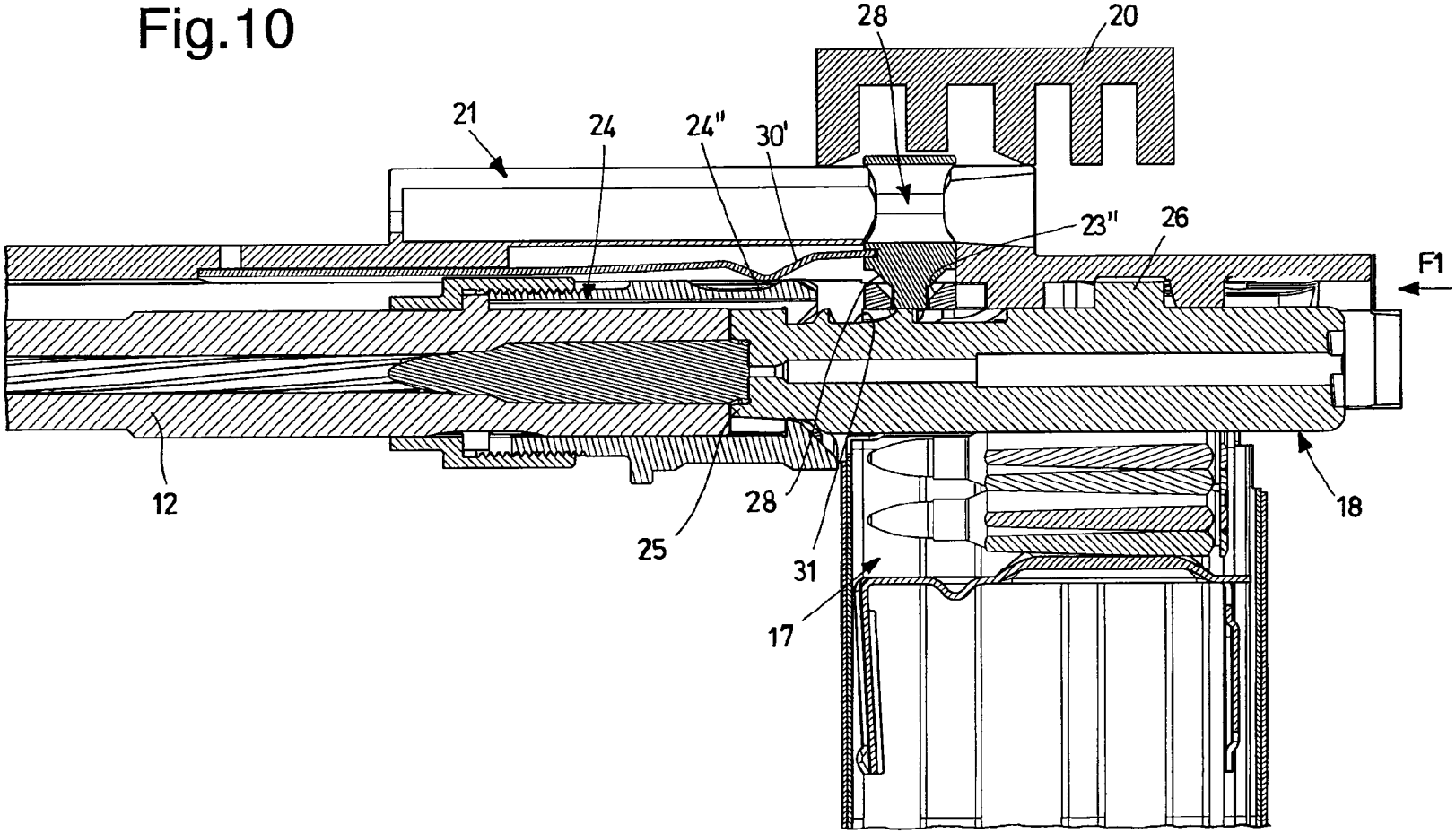

The closing phases of the breech bolt assembly, described on the basis of FIGS. 9 and 10, above all provide for the housing of the first cartridge of the magazine 17.

At the end of the advance movement of the slide 21 and breech bolt 18, according to the arrows F1 and F2 of FIG. 9, respectively, the control pin 28 is unblocked. The coupling between the front branch of the "V"—portion 30' of the recoil spring 30 with the tilted surface 24' of the barrel extension 24, vertically lifts the pin 28 (FIG. 10), this movement being allowed by the cavity 20' of the cam 20 of the body 14.

When the breech bolt 18 reaches the end of its run (FIG. 10), the cam means 26 and 27 guide the rotational-translatory movement between the breech bolt 18 and the slide 21, which is no longer hindered by the control pin 28.

Under closed conditions of the breech bolt assembly, as shown in FIG. 5, the control pin 28 is engaged in the containment seat 31.

For the manual reloading of the firearm, the cocking handle 23, integral with the slide 21 on the right or left side, transmits to this, the advance and/or withdrawal movement described above for the firing phases.

FIG. 2 shows, for illustrative purposes, the cocking handle 23 in the two operating positions, in a continuous line and dashed line.

Figure 11A:
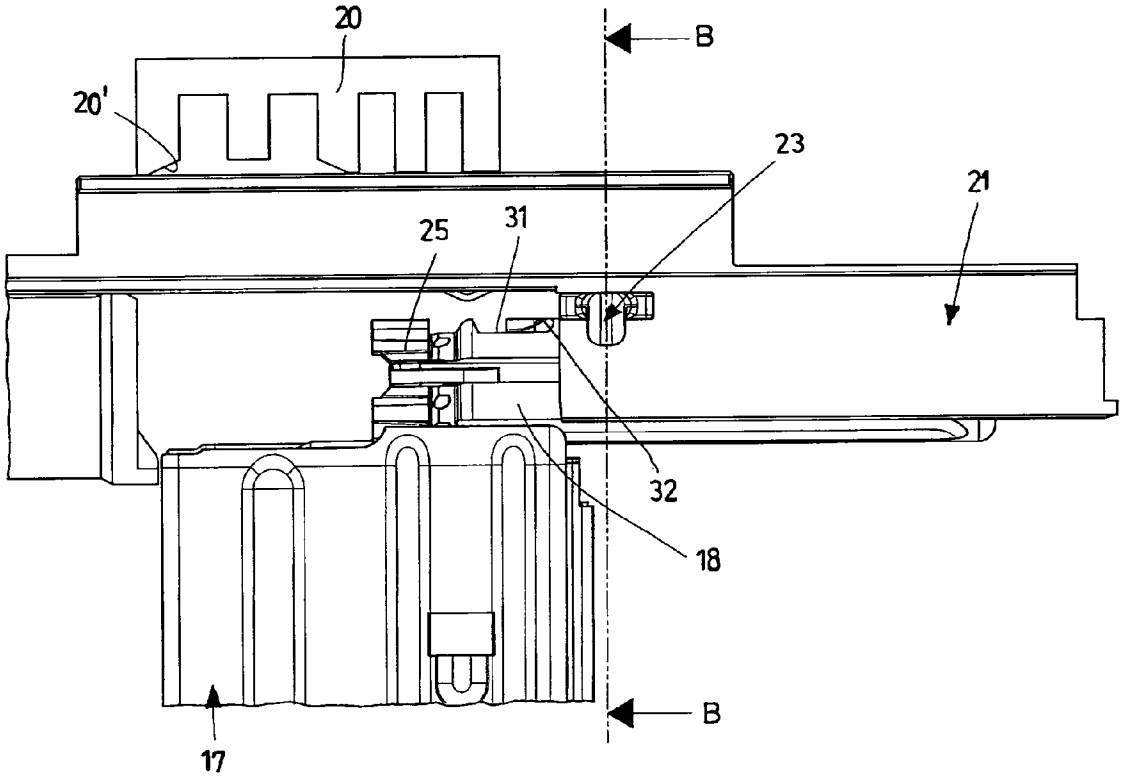
Figure 11B:
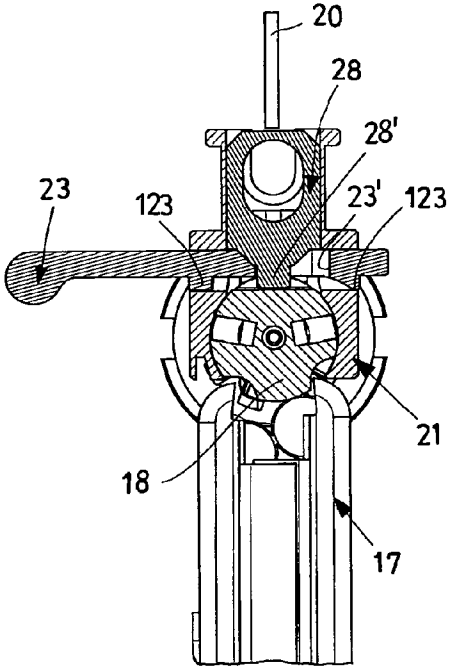

FIGS. 11A and 11B respectively show a raised side view and sectional view according to the marked surface B-B, a breech bolt assembly 10 according to the invention, in which the cocking handle 23 is in an operating position. The cocking handle 23 is kept in a stable position for the rotation through engagement of the reliefs 123 with the complementary seats 21" of the slide 21 (FIG. 11B).

Figure 12A:
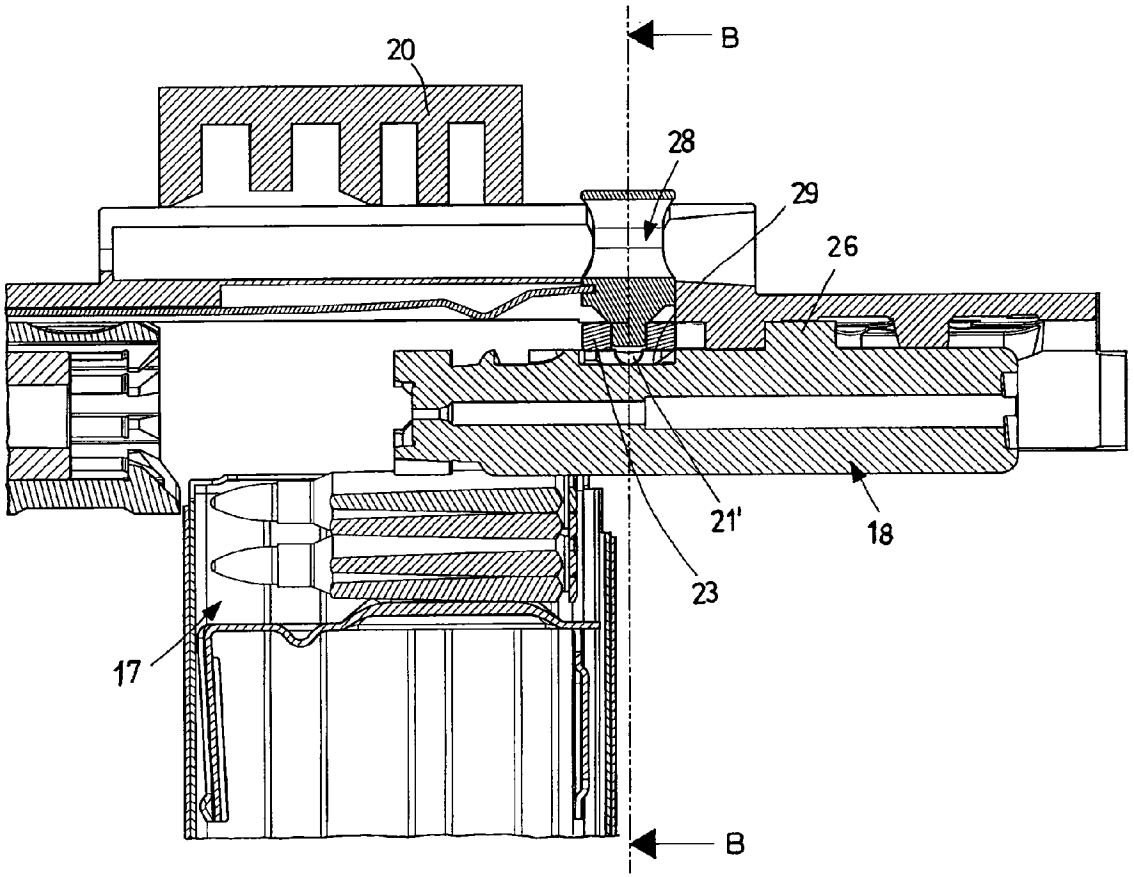
Figure 12B:
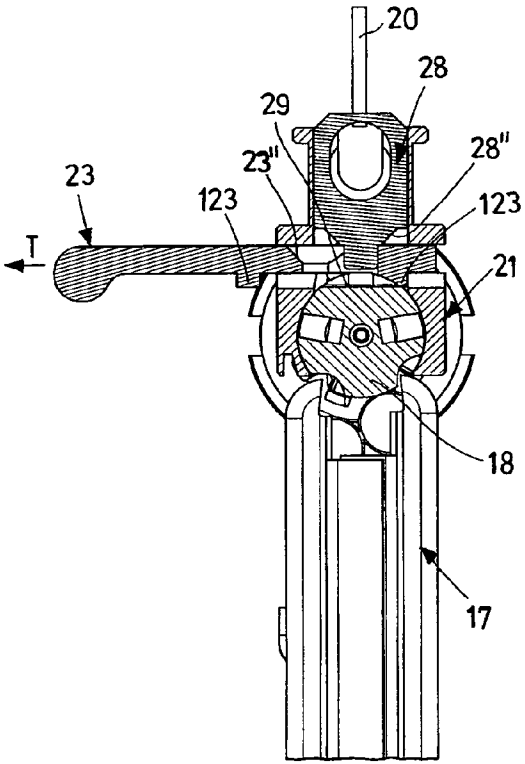

In order to rotate the cocking handle 23 by 180° around the pin 28, it is sufficient to open the breech bolt assembly 10 in a more withdrawn position with respect to the cam 20 of the body 14, so that the pin 28 can be lifted vertically without hindrances by moving the cocking handle 23 transversally with respect to the axis of the barrel 22 following a limited run along the arrow T (FIG. 12B). The control pin 28 is therefore lifted as a result of the coupling with the cocking handle 23 on conical surfaces against the force of the spring 30. The control pin 28 remains in a lifted position resting on the flat upper surface of the cocking handle 23 (FIGS. 12A and 12B).

Figure 13A:
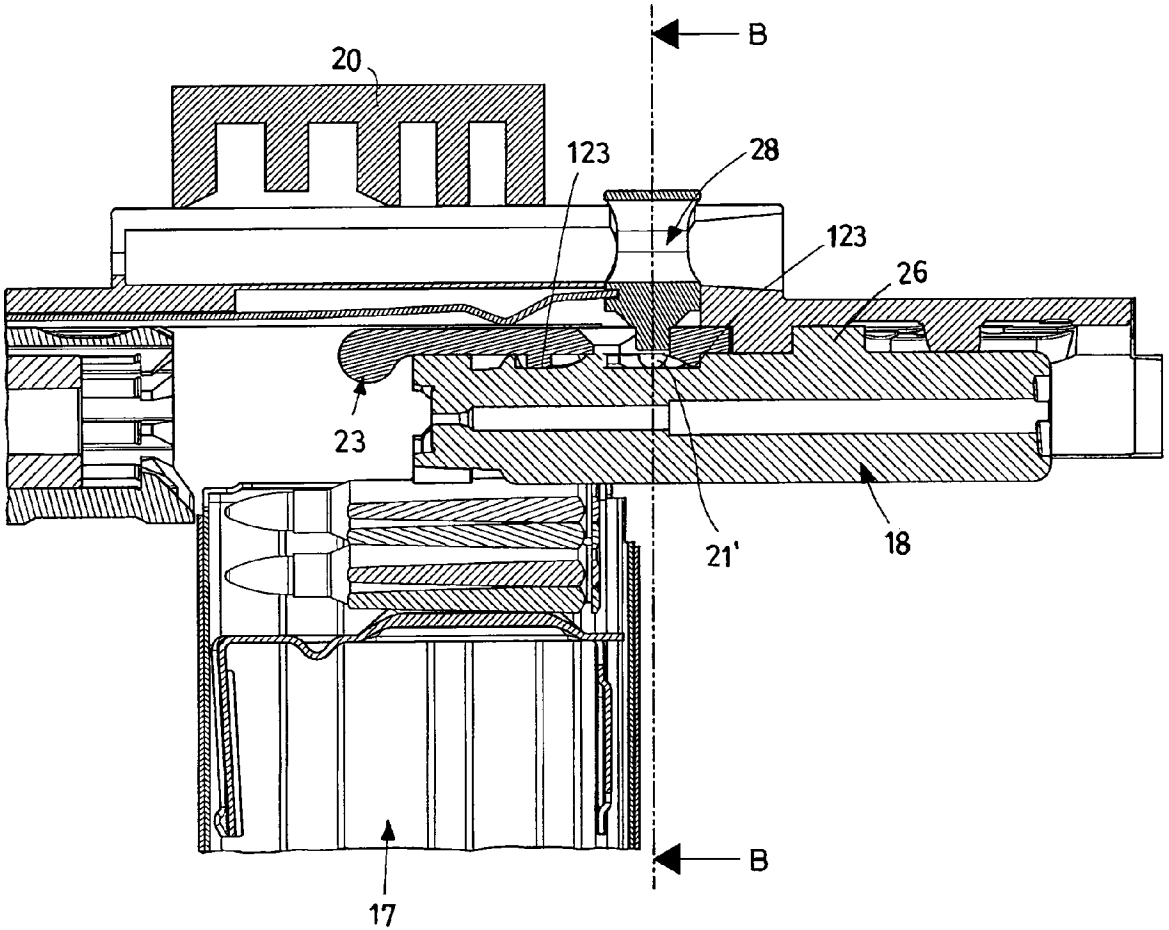
Figure 13B:
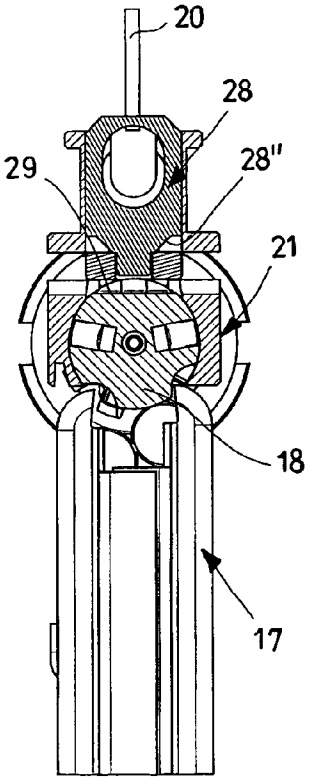

The cocking handle 23 is disengaged from the seats 21" of the slide and is free to rotate around the axis of the pin 28 and be positioned, for example, longitudinally with respect to the barrel 12, to allow the extraction of the breech bolt assembly 10 from the body 14 without disassembling any piece (FIGS. 13A and 13B).

When the cocking handle 23 is in a rotation position, the control pin 28 is vertically extracted and protrudes with respect to the slide 21.

The interference between the pin 28 and cam 20 of the body keeps the breech bolt 18 firmly open during the rotation operations of the cocking handle.

By continuing the rotation, the cocking handle 23 can be rotated on the opposite side, in a specular position with respect to FIGS. 12A and 12B, and consequently through a transversal passage in the direction of the slide 21, it can be brought back into the stable operating position, which is specular with respect to FIGS. 11A and 11B. The action of the recoil spring 30 brings the control pin 28 back into engagement on the cocking handle 23 on the coupled conical surfaces.

This procedure can also be effected with the firearm assembled.

When the cocking handle 23 is in an operating position, arranged orthogonally with respect to the axis 22 of the barrel 12, this cannot be rotated and has all the advantages of a cocking handle firmly constrained to the breech bolt assembly 10.

The necessity of lifting the control pin 28 against the force of the spring 30 to rotate the cocking handle, also advantageously allows the movement to be more safely controlled.

The assembly of the cocking handle 23 on the control pin 28, when the breech bolt is closed, at the end of the advance phase, allows the cocking handle 23 to be situated at the front end of the ejection port 15 of the body 14, i.e. in the normal position of the cocking handle 23.

Furthermore, this advantageously allows the ejection port of the cartridge cases 15, in any case present, to be used for the passage of the cocking handle 23. It is sufficient, in fact, to envisage the additional slit 16 towards the rear end of the port 15, with a lower height with respect to the port, to allow the cocking handle 23 to effect the whole run necessary.

This advantageously requires a minimum removal of material from the body and consequently a minimum weakening of the body itself, which is above all equal on opposite sides.

The firearm with an improved breech bolt assembly, object of the present invention, also has the advantage of allowing a rapid assembly and disassembly without the removal of loose pieces.

The firearm with an improved breech bolt assembly thus conceived, can undergo numerous modifications and variants, all included in the invention; furthermore all the details can be substituted by technically equivalent elements. In practice, the materials used, as also the dimensions, can vary according to technical requirements.

The invention claimed is:

1. A firearm with an improved breech bolt assembly comprising:

a barrel, a breech bolt assembly, a body equipped on opposite sides with ports for the ejection of a cartridge case, in addition to a magazine, wherein said breech bolt assembly, which is moveable with respect to said body comprises a breech bolt-holder slide, a breech bolt equipped with a rotating locking head, cam guide rails of the relative movement between the breech bolt and slide, and also stopping means for said relative movement, wherein said stopping means comprise a control pin which can be moved vertically with respect to a first control seat, charged by a recoil spring applied between said slide and said pin, wherein said pin has a cocking handle, or reloading lever, rotatingly applied thereto, for the manual moving of said breech bolt assembly.

2. The firearm according to claim 1, wherein said recoil spring is a lamina spring constrained to said slide at one end and constrained to said pin at the opposite end.

3. The firearm according to claim 2, wherein said spring comprises a "V"-folded portion near the constraining end with said pin, wherein a front branch of said "V"-folded portion is complementary with a tilted surface, or cam of a barrel extension which guides the vertical lifting of said control pin during the closing of said breech bolt assembly.

4. The firearm according to claim 1, wherein said breech bolt comprises a second containment seat of said control pin adjacent and advanced with respect to said first seat.

5. The firearm according to claim 4, wherein said second seat comprises, at a rear end, a ramp, for cam guiding the lifting movement of the control pin during the opening of said breech bolt assembly.

6. The firearm according to claim 1, wherein said control pin is housed inside a complementary seat of the slide.

7. The firearm according to claim 6, wherein said control pin comprises a main body coupled with said seat and a feeler end, connected with the main body by means of conical surfaces, complementary to a conical hole of said cocking handle.

8. The firearm according to claim 1, wherein said body comprises cam means for controlling the vertical lifting of the pin in an upper facing position with respect to the control pin and equipped with a cavity to allow the vertical movement of the control pin only within a pre-established range of the relative movement between said slide and said body.

9. The firearm according to claim 1, wherein said cocking handle protrudes from said body through said ejection ports and through slit extensions during its run.

10. The firearm according to claim 9, wherein said body is symmetrical.

11. The firearm according to claim 7, wherein said conical hole comprises, in a transversal direction with respect to the axis, a grooved seat which allows the transversal movement of the cocking handle, said transversal movement being suitable for vertically lifting the control pin.

12. The firearm according to claim 1, wherein said slide is equipped on both sides near said cocking handle, with seats for a firm coupling with reliefs complementary to said cocking handle.

13. The firearm according to claim 12, wherein said cocking handle can be moved transversally with respect to said axis from an operating position, in which it is firmly constrained to said slide by means of said coupling between seats and complementary reliefs, orthogonally with respect to said axis, to a regulation position in which it can be freely rotated by an angle equal to 180°.

* * * * *